United States Patent [19]

Barnich et al.

[11] 4,109,244

[45] Aug. 22, 1978

[54] DIGITAL PROCESSOR FOR GENERATING ALPHANUMERIC DISPLAY ON A CATHODE RAY TUBE

[75] Inventors: Richard G. Barnich, Grand Blanc; Timothy M. Hakeem, Pinckney, both of Mich.

[73] Assignee: Process Computer Systems, Inc., Saline, Mich.

[21] Appl. No.: 721,285

[22] Filed: Sep. 8, 1976

[51] Int. Cl.[2] ..... G06F 3/14

[52] U.S. Cl. ..... 340/324 AD; 178/30

[58] Field of Search ..... 340/324 A, 324 AD; 178/30

[56] References Cited

U.S. PATENT DOCUMENTS

| | | | |
|---|---|---|---|
| 3,559,207 | 1/1971 | Atkinson | 340/324 AD |
| 3,637,997 | 1/1972 | Petersen | 340/324 A |
| 3,848,232 | 11/1974 | Leibler et al. | 340/324 AD |
| 3,895,374 | 7/1975 | Williams | 340/324 AD |

*Primary Examiner*—Marshall M. Curtis
*Attorney, Agent, or Firm*—Krass & Young

[57] ABSTRACT

A CRT display system is connected to a central processing unit over a bus and includes a random access memory which is filled and modified under the control of the computer and contains a sequence of codes defining characters to be displayed on the screen in successive locations. An oscillator controlled divider chain increments an address counter and also provides vertical and horizontal synchronization and retrace signals. A character generator which receives a character code from a RAM location designated by the counter as well as timing signals from the divider chain controls intensity modulation of the CRT display. Multiplexers interposed at various points in the divider chain receive the output of several stages of the preceding divider and operate under control from the CPU to determine which output is provided to the next element in the chain, thereby controlling the character size and spacing on the screen. During the vertical retrace a signal is provided by the divider chain to the CPU and major changes are made in the contents of the RAM. When the CPU is changing the RAM contents during the display process, the character being provided by the CPU is provided to the character generator rather than the character at the RAM stage designated by the counter. This produces an instantaneously erroneous display but substantially simplifies the system's circuitry.

10 Claims, 4 Drawing Figures

DIGITAL PROCESSOR FOR GENERATING ALPHANUMERIC DISPLAY ON A CATHODE RAY TUBE

BACKGROUND OF THE INVENTION

1. Field of the Invention

This invention relates to display processors and more particularly to a video display system employing a central processing unit, a display memory, and a cathode ray tube display device.

2. Prior Art

Computer controlled video display systems, typically employing cathode ray tubes as the display device, are used as output devices in many computer systems. When the common type of low persistence cathode ray tube is used as the output device it is necessary to repeatedly generate the video command signals at a rapid rate, typically 60 frames per second. While it would be possible for a central processing unit to directly and continuously provide the video data required for this regeneration process, that arrangement would be wasteful of the computer's resources since text to be displayed is typically unchanged in most of its detail during successive repetitions. A more economical arrangement provides a memory for storing the text to be displayed and allows the central processing unit to modify the contents of that memory as required. These display memories and the associated components which generate the required display from the memory contents are termed display processors. A wide variety of such processes have been employed or proposed. Typically the display processors have employed circuitry for assembling a series of character codes representative of a single horizontal line across the display screen from the display memory and have continually scanned or recirculated this information until the plural number of successive horizontal scans required to write these lines on the display have been performed. Some systems have used recirculating delay lines to continually present the required one of the characters in each line segment to a character generator. These systems have been relatively complicated and accordingly expensive and as the cost of computation ability has decreased the relative cost of the display processor portion of the system has increased.

SUMMARY OF THE INVENTION

The present invention is accordingly directed toward a simplified form of processor which is substantially lower in cost and more reliable in operation than the prior art process.

One aspect of novelty of the systems of the present invention lies in the provision of means for feeding a character code to be displayed directly from the random access memory of the display processor to a character generator, without the use of recirculating line buffers or the like employed in the prior art. Each time a character code is selected from the random access memory it is used to generate the video intensity signals required for the generation of a single horizontal line scan across the character. Since characters are generated on the screen by a series of such horizontal scans, typically 8 or 9, this requires that the single character code be repeatedly accessed to generate the full character. This accessing is controlled by a memory counter which operates in timed relation to the horizontal and vertical display controls.

The processors of the present invention also greatly simplify communication between the central processing unit and the display memory so that the memory contents may be modified at times compatible with the CPU's need to perform other tasks on a priority interrupt basis, without appreciably degenerating the display format.

The processor format is such that it can be used in a system in which a CPU communicates with the other system components over a central bus.

The display generated by the processor of the present invention may be conveniently switched between a plurality of display formats in which the characters have differing sizes of spacings under a simplified form of CPU control.

A preferred embodiment of the display processor of the present invention, which will subsequently be disclosed in detail, employs a random access memory which stores character codes for successive characters to be generated in the display at successive memory locations. A crystal controlled oscillator within the display processor acts as an internal clock and triggers a chain of digital dividers to generate horizontal and vertical timing signals for the display device, preferably on a cathode ray tube, as well as timing signals for a character generator and memory address signals. A switching or multiplexing circuit receives the memory address signals from the divider chain and uses them to select a character code from the memory to be provided to the character generator, unless the display processor is being addressed by the CPU at that instant, in which case the memory address provided by the CPU determines the character code provided to the character generator. Simultanteously, the CPU may be reading the character code stored in the addressed memory locations or writing a new code in that location. In the latter case, what appears to be a blank, but which is actually an erroneous character, will be provided to the character generator. The time period during which the normal display is altered by the blank is so short that the observer will not likely notice any display distortion.

To eliminate the grosser distortion which would occur if substantial sections of the memory were being read or altered by the CPU during the display process, the processor signals the CPU during the occurrence of a vertical retrace time. This time is sufficient for the computer to modify the entire contents of the memory without interrupting the display.

This display arrangement greatly simplifies the structure of the processor by eliminating the need for the buffer sections used in the systems of the prior art to store a display segment so that the memory could be read or altered by the CPU simultaneously with the generation of the display.

To allow the CPU to control character size and number of lines in the display several switches or multiplexers are inserted in the divider chain that generates the display timing signals and the memory address code. These multiplexers each have inputs from a number of stages in the upstream divider, preferably the last three stages, and a signal from a CPU controlled latch determines which of the three signals is provided to the downstream divider. In this manner the display format may be modified by binary factors.

The resultant system is extremely simple and well adapted to interconnection with common bus-type systems.

Other objectives, advantages and applications of the present invention will be made apparent from the following detailed description of a preferred embodiment. The description makes reference to the accompanying drawings in which.

Figure 1:
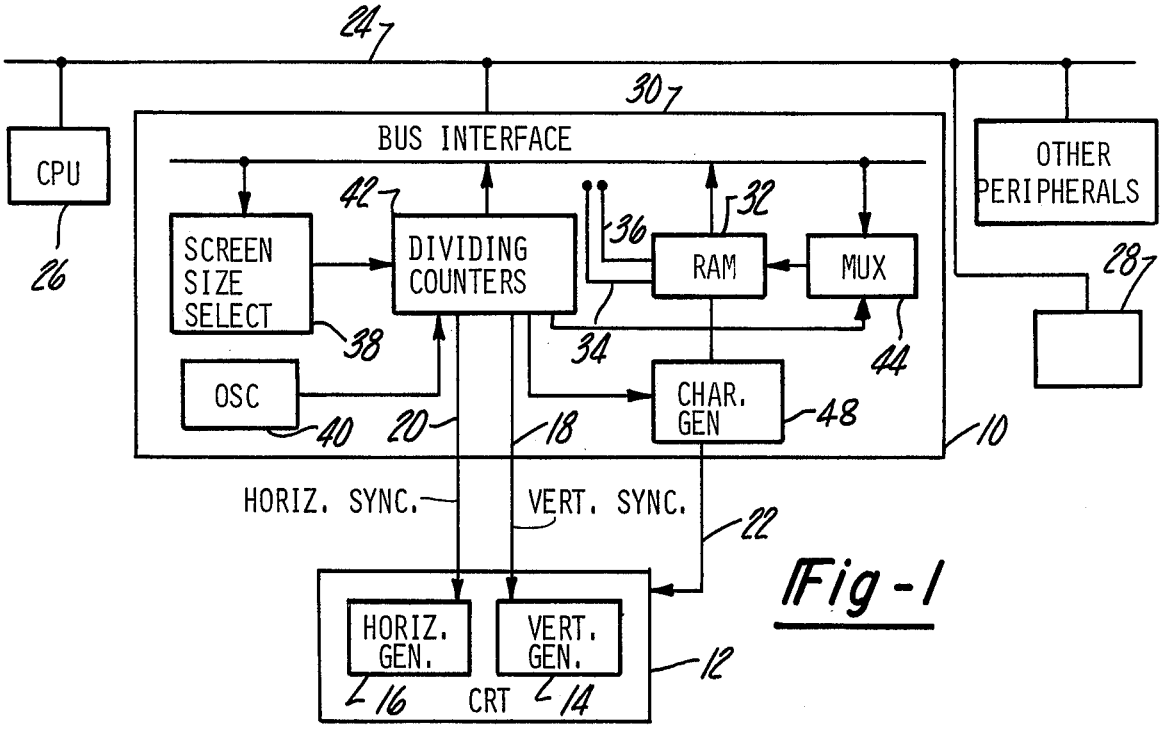
FIG. 1 is an overall block diagram of a computer system incorporating a central processing unit interconnected with a display processor and other devices by a central bus system.

Referring to FIG. 1 the display processor 10 of the present invention is adapted to control the display generated on a display device 12, preferably taking the form of a cathode ray tube. The cathode ray tube assembly 12 will normally incorporate a vertical ramp generator 14 which generates the analog signals which control the point of vertical display of the cathode ray beam on the tube, and a horizontal ramp generator 16 which similarly controls the horizontal beam position. The processor 10 controls the vertical generator 14 by way of a vertical synchronization signal provided on line 18. The horizontal oscillator 16 is similarly controlled by a horizontal synchronization signal provided on line 20. The instantaneous intensity of the cathode ray beam is controlled by a video signal provided on line 22.

The input to the display processor 10 is provided on a bus 24 which includes a plurality of lines. This bus connects to a central processing unit 26 as well as other devices 28, such as various input/output devices, other processors and the like. The mass memory for the central processing unit CPU 26 may also be connected on the bus. This common bus 24 is of the conventional type. It may include address lines, data lines, interrupt lines, etc.

The display processor 10 includes a bus interface 30 which interconnects the bus 24 with the other processor components. The interface 30 includes address circuitry which defines a unique address for the processor 10, and circuitry for comparing an address provided on the bus 24 with that stored address. When the stored and transmitted addresses are identical, the interface 30 decodes the associated bus information and provides it to various units in the processor 10. A random access memory 32 within the processor can receive data from the bus or supply data to the bus via the interface 30. Lines 34 and 36 from the interface 30 control whether data is read into or out of a particular memory location addressed by the CPU 26 over the bus 24.

The random access memory 32 will normally store the character codes required for one full screen display of the cathode ray tube 12, although the memory could be larger in size and store more information. Each character is defined by an 8-bit code in which 6 bits define the character in ASCII format and the last 2 bits define the nature of the display, either black characters on a white background or vice versa, and whether the characters are to be displayed continuously or blinked. The character codes are stored in memory in the order in which they are to be displayed on the screen.

In addition to being able to read or alter the contents of any location in the random access memory 32, the CPU's only other control of the processor 10 is to select the screen size by information provided to a screen size selection latch 38 via the bus interface 30. In the preferred embodiment of the invention the display may take the form of any one of three binary related formats; 16 lines by 64 characters; 8 lines by 32 characters; or 4 lines by 16 characters. The character size varies inversely with the content of the display so that in the 8 line display the characters are twice as high and twice as wide as in the 16 line display, and in the 4 line display the sizes are again doubled.

The display generation operates asynchronously of the CPU 26, under control of its own internal oscillator 40. The outputs of this oscillator are provided to a chain of dividing counters 42. The configuration of the dividing chain is determined by signals from the screen size select circuit 38. The dividing counters 42 provide an output to a multiplexer 44 which also receives a line from the bus interface 30 which carries a memory address location at such time as the CPU 26 is accessing the RAM 32. The multiplexer 44 provides either the address determined by the dividing counters 42, or the memory address from the bus 24 to the memory 32.

The dividing counter also provides outputs to a character generator 48 which additionally receives the contents of the memory location addressed by the memory address unit 46. The character generator 48 generates the video signals on line 22 which control the intensity of the cathode ray tube display. Additionally, the divided counters 42 provide a signal to the bus interface 30 which indicates when the display is undergoing a vertical retrace. This information is relayed to the central processing unit in a manner which will be subsequently described. The dividing counters also provide the horizontal and vertical synchronization signals to the video display 12 over lines 18 and 20.

Broadly, in operation, the processor 10 operates under control of the oscillator 40. The oscillator outputs cause the dividing counter to generate vertical and horizontal synchronization signals for the display 12 in accordance with a format determined by the screen size select unit 38. The dividing counters also control the provision of a character code stored in the RAM 32 to the character generator 48, and provide the timing signals which cause the character generator to generate video signals. During this process signals are provided to the CPU via the bus 24 which allow the CPU to determine the condition of vertical retrace. At any time during the cycle, but typically during vertical retrace, the CPU 26 can read or alter the contents of any selected address location in the RAM 32. During such accessing by the CPU the signal on the data line of the bus is provided to the character generator 48. The CPU can also modify the signal latched in the screen size select circuitry 38 to control the operative configuration of the dividing counter 42.

The CPU 26 thus treats the display processor 10 as memory which may be written into or read from and allows it to continuously display the data stored in the random access memory.

Figure 2:
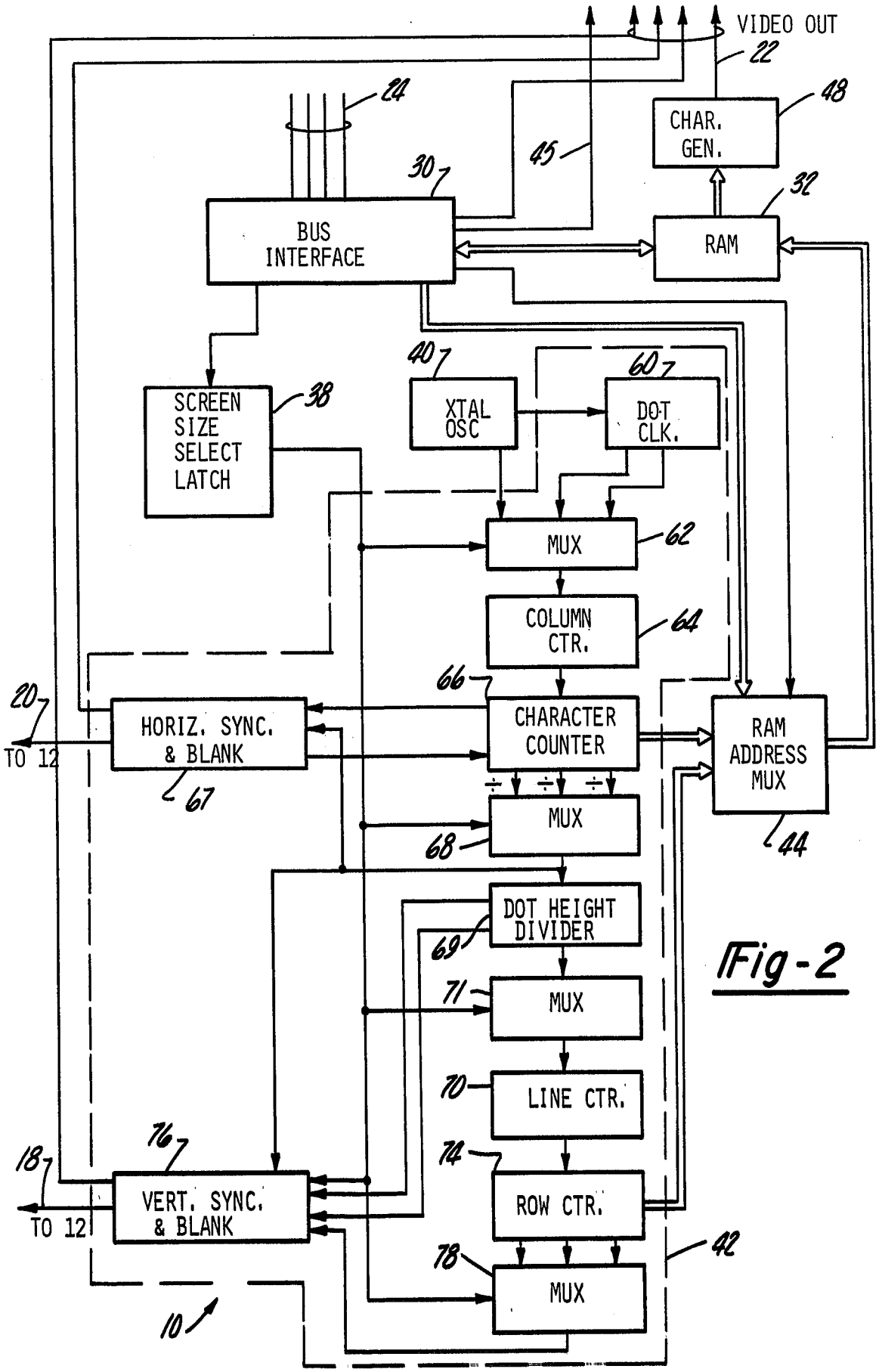
FIG. 2 is a partially schematic diagram of the divider chain and associated circuitry employed with the preferred embodiment of the display processor.

Before considering FIG. 2 which details the structure of the display controller 10 and more particularly the dividing counter chain 42, the terminology of this system should be considered. The most elementary display unit will be termed a dot. A character is formed by a matrix of seven dots horizontally and nine dots vertically. Of course, in other embodiments of the invention other matrix sizes may be employed. The matrix of dots for each character is stored in a read-only memory contained within the character generator 48. When a particular character code is fed into the character generator from the RAM and a particular line number is fed to the character generator from the divider chain 42, the character counter will present a serial train of bits which represents the matrix elements of the defined character across the identified horizontal line. The 7 bits of a character plus 2 bits of space between characters is termed a column and after 16 or 32 or 64 columns have been generated depending upon the screen display format, a single horizontal line has been completed. The 9 vertically arrayed bits in a character matrix plus the 6 spaces vertically between characters are termed a row and after the generation of 4, 8 or 16 rows, again depending upon screen format, a screen has been filled.

Turning to FIG. 2, the output of the crystal oscillator 40 changes state at a rate equal to the rate of generation of the dots in the matrix for the screen display format having the maximum number of characters, i.e. 64 characters per row. The output of the oscillator 40 is provided to a dot clock 60 within the divider chain 42 which includes a chain of two divide by two counters. The outputs of these two counters as well as the output of the oscillator 40 are provided to a first multiplexer 62 which also receives a signal from the screen size select latch 38 which is loaded by the CPU. The multiplexer 62 provides one of its three inputs from the oscillator 40 or the dot clock 60 to a column counter 64, depending on the nature of its input latch 38. If the selected screen format has 64 characters per row, the output of the oscillator 40 is provided to the column counter by the multiplexer 62; if the screen format is to have 32 characters per row, the output of the oscillator divided by 2 is provided to the column counter; if the format is to have 16 characters per row, the output of the oscillator divided by 4 is provided to the counter. Since the rate of traverse of the cathode ray beam across the screen is determined by the horizontal deflection generator 16 independently of the inputs to the dividing counter 42 which only synchronize the start of a horizontal scan line, the multiplexer 62 effectively determines the width of a dot in a character matrix, across the cathode ray tube screen. Considering the distance of horizontal traverse of the cathode ray tube beam between two changes of state of the oscillator 40 to be an elemental dot size, when the multiplexer 62 divides this output by 2, the effective width of the dot in the matrix is doubled, and dividing it by 4 quadruples the width of the matrix element since the beam moves proportionally farther in a basic dot time.

The column counter 64 includes a train of binary elements with appropriate feedback connections which produce an output pulse after receipt of nine input pulses. Thus, an output from the column counter 64 indicates the end of generation of a character. The output of the counter 64 is provided to a character counter 66. This unit counts the number of characters or columns and provides the instantaneous column address to the RAM address multiplexer 44. Unit 66 also provides certain timing signals to a horizontal synchronization and blank generator 67 which generates a signal provided to the display on line 20. The generator 67 provides the counter 66 with a reset signal at the end of each horizontal retrace.

A multiplexer 68 receives outputs of various stages in the column address unit 66 and under control of the screen size select latch 38 provides an end of line signal, after 16, 32 or 64 columns have been generated, to a dot height divider 69. This unit comprises a chain of 2 divide by 2 counters. These two outputs, plus the primary output from the multiplexer 68, are provided to another multiplexer 71 which is also controlled from the screen size select latch 38. This multiplexer effectively controls the height of a single dot in the matrix by controlling the number of outputs from the multiplexer 68 which are generated before a line is considered completed. If multiplexer 71 generates a single output for each output of the multiplexer 68, a particular line in the character matrix will only be generated during a single horizontal sweep of the cathode ray beam across the tube. If the multiplexer 71 provides an output for each two outputs from the multiplexer 68, then a particular line in the matrix will be repeated twice. If the multiplexer 71 provides an output for each 4 outputs of the multiplexer 68, a particular line will be generated four times. The outputs of the multiplexer 71 are provided to a line counter 70. The dot height divider 69 also provides signals to a vertical SYNC and blank generator 76.

Unit 70 counts the 15 lines of character segments plus spaces which make up one horizontal line across the display. The multiplexer 71 provides an output to the character generator 48 which determines the horizontal line in a character matrix which is outputed by the character generator. As has been noted, this signal may remain constant for one, two or four horizontal traces of the cathode ray tube, depending upon the output provided by the multiplexer 71.

After 15 counts have been received from the multiplexer 71 an end of line signal from the counter 70 is provided to a row counter 74 which provides the address row to the RAM address multiplexer 44.

The combination of a column address from unit 66 and a row address from unit 74 define a memory address. Certain timing signals from the dot divider 69 are also provided to a vertical SYNC and blank generator 76.

Outputs which occur from the row counter after 4, 8 and 16 row input signals are provided to a multiplexer 78 which receives the signal from the screen size latch 38. Depending on the nature of that signal, one of these outputs is gated to the vertical SYNC and blank generator 76, signifying the end of the screen. Then a timing signal derived from the dot height divider 69 allows time for a blank during the resulting vertical retrace. The intensity output line 22 to the video display 12 is provided by the output from the character generator 48, the blanking signals provided by the horizontal and vertical SYNC generators 67 and 76 respectively and signals from the RAM memory 32 which indicate reverse video or blinking.

All of this circuitry performs the function of generating the horizontal and vertical synchronization and blank signals and providing an address to the RAM multiplexer. In the absence of a signal from the bus interface indicating that the display processor is being signalled by the CPU, the RAM address multiplexer 44 provides this divider generated address to the RAM 32 which provides the character code stored in the designated memory location to the character generator 48. In the event the processor is being addressed by the CPU a signal from the bus interface 30 causes the multiplexer 44 to provide the address on the address lines of the bus to the RAM 32 and the character code on the data bus is provided to the RAM 32.

The timing signals provided to the character generator 48 by the line counter 70 cause it to generate a series of intensity signals on line 22 which either cause a black or a white point to be generated on the instantaneous point of the display. A video blanking signal is generated on line 45 from the bus interface 30 when the CPU is accessing RAM 32.

Figure 3:
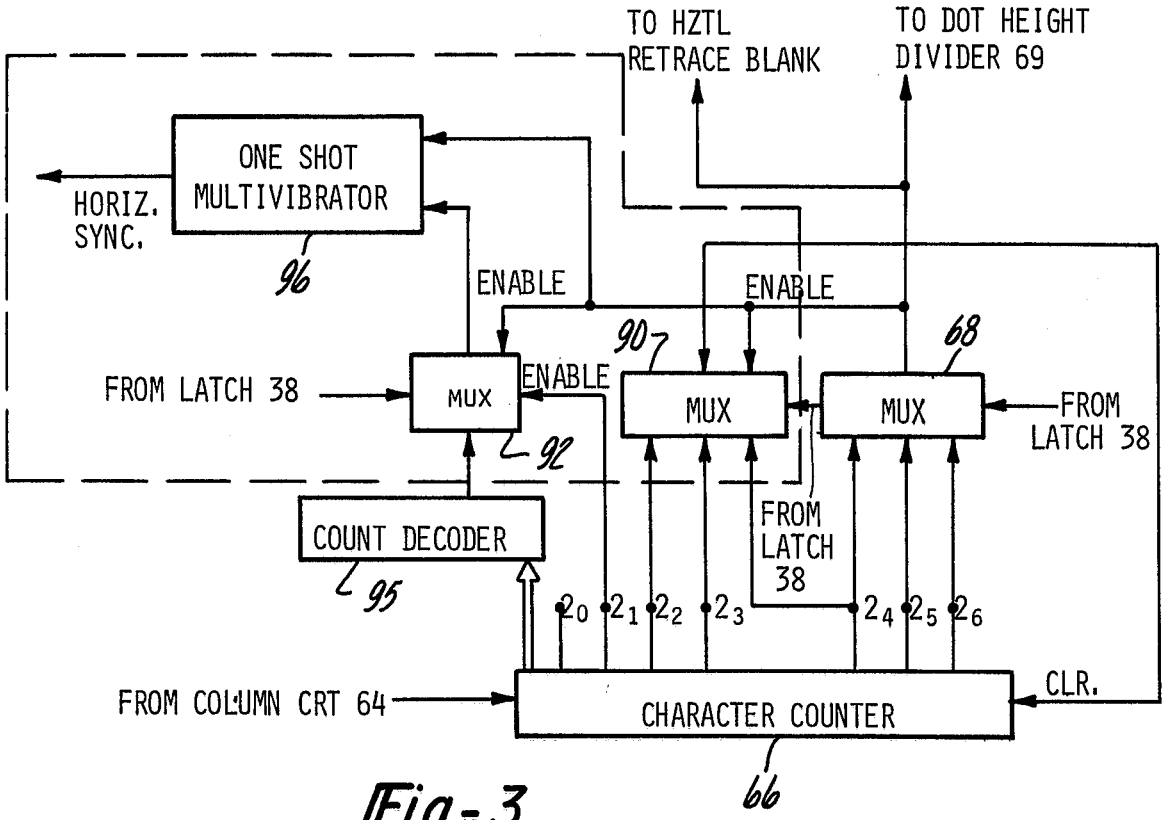
FIG. 3 is a partially block, partially schematic diagram of the horizontal synchronization and blanking circuit employed with the preferred embodiment of the invention.

The horizontal synchronization and blank generator 67, and certain connected components, are detailed in FIG. 3. The character counter 66 includes seven binary stages and outputs from the three most significant stages are provided to the multiplexer 68. Under control of the latch 38, this multiplexer provides an output which represents the end of one horizontal line across the display screen. In addition to being provided to the dot height divider 69, this output forms part of line 22 which blanks the screen during horizontal retrace.

This end of line signal from multiplexer 68 is also provided to a multiplexer 90 as an enabling signal. The multiplexer 90 is controlled by the latch 38 and receives outputs from the third, fourth, and fifth most significant stages of the character counter 66. When the output of the particular character counter stage selected by the latch 38 goes high and an enable signal from multiplexer 68 is present, the multiplexer 90 provides a clear signal to the character counter 66. This terminates the output of the multiplexer 68 and signals the end of the horizontal retrace. Multiplexer 90 thus acts to provide a constant horizontal retrace period independent of the number of dots per character as chosen by the multiplexer 62 which is upstream in the dividing chain from the character counter 66.

The end-of-line output from the multiplexer 68 also acts as an enabling input to a one-shot multivibrator 96 which operates with associated circuitry to generate one short horizontal synchronization pulse at an appropriate time during the horizontal retrace time. The particular time chosen will depend on the exact characteristics of the horizontal synchronization generator 16, but will preferably occur toward the middle of the horizontal retrace time.

A second enabling input to the one-shot multivibrator 96 comes from multiplexer 92. This input acts to time the beginning of the synchronization pulse an appropriate time after the beginning of the horizontal retrace. When both enabling inputs are received, the one-shot 96 fires. The multiplexer 92 is used to select the appropriate time to enable the one-shot 96 based on defined counts determined by a decoder 95 which receives the outputs of the character counter 66. This selection is necessary since the clock rate provided to character counter 66 is dependent upon screen size. Multiplexer 92 is controlled by the latch 38 which contains screen size selection data.

The output of the one-shot 96 occurs on line 20 which provides the horizontal synchronization pulse to the horizontal SYNC generator 16 within the display 12.

The horizontal SYNC pulse generating circuit remains inactive until another end-of-line signal arrives on line 68. This circuitry thus provides a single synchronization pulse on line 20 which occurs a predetermined period of time after the beginning of the horizontal retrace time and lasts for a predetermined period, terminating before the end of the horizontal retrace.

Figure 4:
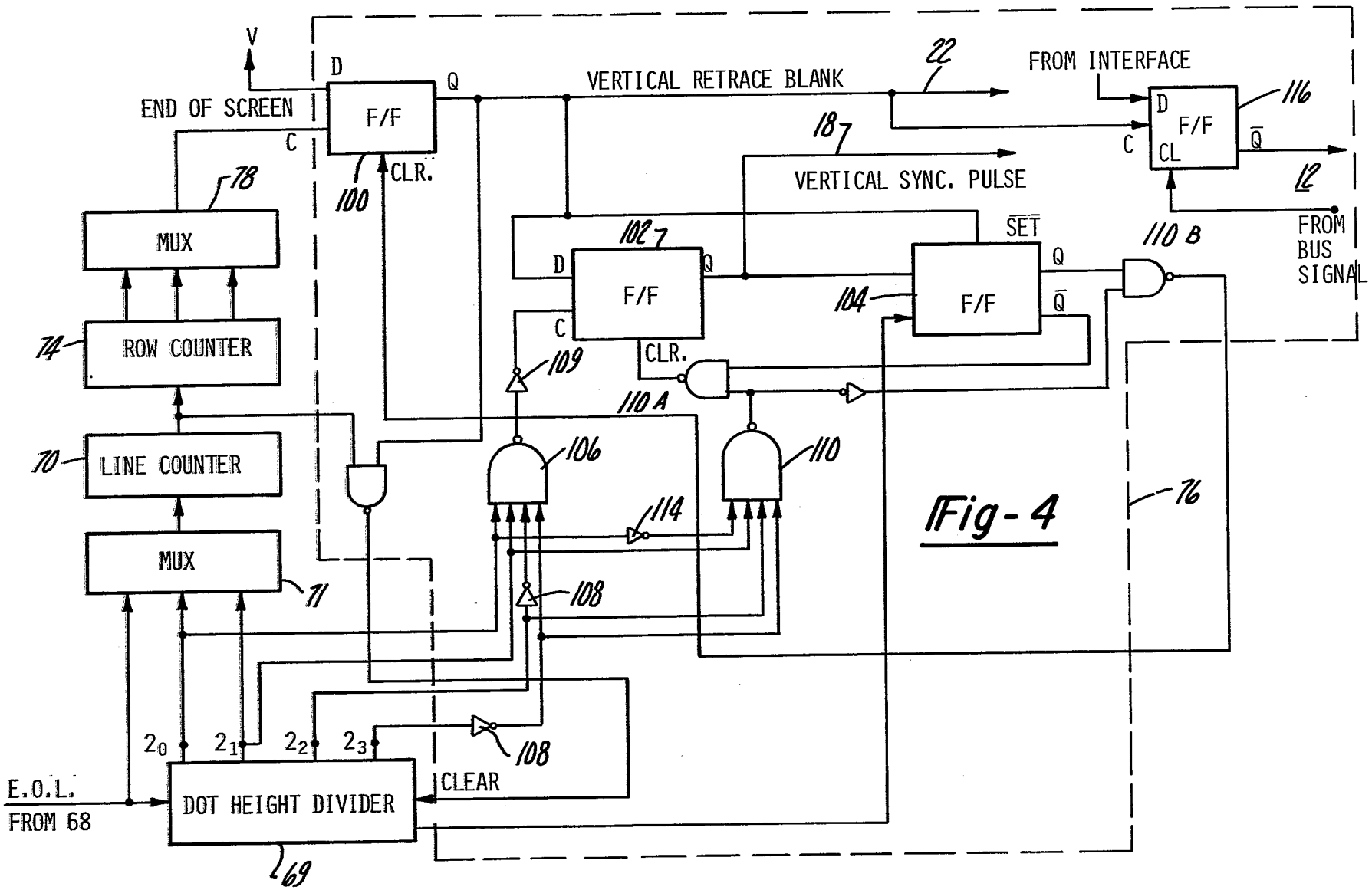
FIG. 4 is a partially block, partially schematic diagram of the vertical synchronization and blank circuitry employed in the preferred embodiment of the invention.

The circuitry of the vertical synchronization blank generator 76, and certain associated elements of the dividing chain 42, are illustrated in FIG. 4. The output of the multiplexer 78 which represents an end-of-screen signal is provided to the clock input of a D flip-flop 100 which has its D input connected to a constantly high source of voltage. Assuming the flip-flop 100 to be initially in a reset stage before receipt of the end-of-screen signal, the Q output of the flip-flop will go high upon receipt of the end-of-screen signal. This line represents part of line 22 in the video output and provides a vertical retrace blank signal.

The output from the flip-flop 100 also goes to the data input of flip-flop 102 and flip-flop 104. The clocking input to the flip-flop 102 is derived from an inverter 109 fed by an AND gate 106 which senses a combination of certain states of the dot height divider 69. Inverters 108 connected to certain of the input lines to gate 106 encode a particular combination of outputs. This combination of outputs will occur some predetermined number of dot counts after the occurrence of an end-of-screen signal. The exact delay depends upon the use of the inverters 108 in the conditioning inputs to the gate 106.

When the selected count is reached, the gate 106 provides output to the clocking input of the flip-flop 102. Since the data input is high, the Q output goes high. This signal constitutes the vertical synchronization pulse and is provided on line 18 to the display processor 12. The gate 110 is conditioned by a second set of conditions of the various stages of the dot height divider 69, as modified by one or more inverters 114 disposed in the input lines. One or more of the inverters 108 may also condition the inputs to the gate 110.

When this second set of states occurs a clear input is provided to the flip-flop 102. This terminates the vertical synchronization pulse on line 18. Flip-flop 104 is clocked by the carry output of dot height divider 69. The Q output sends signals through gate 110B to the flip-flop 100 which clears that flip-flop and ends vertical blank. The Q output of flip-flop 100 in combination with the output of line counter 70 in gate 100C forms the clear for dot height divider 69. This insures that the dot height divider is maintained in the synchronization with the display generation. At this point the vertical retrace is completed and the next screen is generated.

When the flip-flop 100 is set to initiate the start of the vertical retrace a clock signal is also sent to a flip-flop 116 which receives a signal from the bus interface as its data input. This data signal is present whenever there is no unackknowledged interrupt request in the system. When it is present it causes an output to the interface from the Q output of the flip-flop. The flip-flop is cleared from a signal on the bus which acknowledges the interrupt. The signal from this flip-flop 116 acts as an interrupt request and upon receipt of an interrupt acknowledge signal from the CPU the processor connects the vertical retrace signal on line 22 to a data line of the bus indicating processor retrace status so that the CPU can modify the contents of the RAM memory during vertical retrace time and thus not interrupt the display.

The embodiments of the invention in which an exclusive property or privilege is claimed are defined as follows:

1. A video display system comprising: a random access memory storing a plurality of character codes; a video display device; an oscillator; a chain of digital dividers connected to the output of the oscillator; horizontal and vertical position generators connected to points in the digital divider chain and to the video display device to control the position of the display point on the device as a function of the condition of the dividers in the chain; a character generator connected to the random access memory, the digital divider chain and the video display operative to control the instantaneous illumination of the video display as a function of the condition of the dividers in the chain and the character code stored in the random access memory; and a memory counter connected to the digital chain and operative to control the character code provided by the random access memory to the character generator as a function of the condition of the dividers in the chain.

2. The video display system of claim 1, further including a central processing unit (CPU) connected to the random access memory and to the character generator and operative to control the contents of the random access memory and the character generator.

3. The video display system of claim 1 in which said character generator includes a memory in which is stored a single character code and means for generating signals representative of a sequence of video display illumination intensities required to generate a plurality of parallel lines along one axis of the character defined by the character code stored in the memory.

4. The video display system of claim 2 including a multiplexer interconnecting the CPU and the random access memory with the character generator and control means for causing the multiplexer to provide the character generator with a character code being provided by the CPU to the memory at such time as the CPU is accessing the random access memory, and a character code stored at the random access memory location defined by the memory counter at other times.

5. The video display system of claim 2 wherein said divider chain includes means for causing the vertical position generator to periodically undergo a vertical retrace, and means for signalling the CPU as to the status of said retrace means.

6. The video display system of claim 5 wherein said digital divider chain is connected to the CPU by a bus which connects to a plurality of other devices and the means for signalling the CPU as to the status of the vertical retrace sends such signal over the bus.

7. The video processor of claim 1 including means for selecting one of a plurality of display formats, and including a plurality of gates each operative to receive signals representative of the conditions of different stages in one of said digital dividers, and the output of said selecting means, and operative to control which output of such digital divider which is provided to the successive divider element in the chain, whereby the display format may be controlled.

8. A computer controlled video display system, comprising: a central processing unit; a random access memory connected to the central processing unit; a video display device; an oscillator; a digital divider chain connected to the oscillator and operative to control the instantaneous display position on the video display device and the location in the random access memory in which a character to be instantaneously displayed is encoded, and including periodically operative vertical retrace means for the video display device and interconnections between the divider chain and the central processing unit, operative to generate a signal to the central processing unit indicative of the status of the vertical retrace means, whereby the central processing unit can act to modify the contents of the random access memory during the vertical retrace time.

9. The video display system of claim 8 wherein the interconnections between the central processing unit and the digital divider chain comprise a bus including an interrupt request line, an interrupt acknowledge line, and a data line, and wherein said divider chain is operative to generate a signal on the interrupt request line during the vertical retrace time.

10. The video display system of claim 8 including a character code store within the character generator, and means under control of the divider chain for periodically loading the character code store with a character from the random access memory if no character is being transmitted by the central processing unit.

* * * * *